US005237506A

United States Patent [19]

Horbal et al.

[11] Patent Number: 5,237,506

[45] Date of Patent: Aug. 17, 1993

[54] REMOTE RESETTING POSTAGE METER

[75] Inventors: John J. Horbal, Beacon Falls; James S. Emmett, Derby, both of Conn.; Hans-Peter Liechti, Zollikofen, Switzerland

[73] Assignee: Ascom Autelca AG, Berne, Switzerland

[21] Appl. No.: 481,445

[22] Filed: Feb. 16, 1990

[51] Int. Cl.[5] ..... G07B 17/00

[52] U.S. Cl. ..... 364/464.02; 235/382

[58] Field of Search ..... 235/101, 382, 382.5; 364/464.02

[56] References Cited

U.S. PATENT DOCUMENTS

| | | | |
|---|---|---|---|
| 3,596,247 | 7/1971 | Eckert, Jr. | 340/825.33 |
| 3,792,446 | 2/1974 | McFiggins et al. | 364/900 |
| 4,097,923 | 6/1978 | Eckert, Jr. et al. | 364/900 |
| 4,202,489 | 5/1980 | Schubert | 235/101 |
| 4,447,890 | 5/1984 | Duwel et al. | 364/900 |
| 4,549,281 | 10/1985 | Eckert et al. | 364/900 |
| 4,629,871 | 12/1986 | Scribner et al. | 235/382.5 X |
| 4,635,204 | 1/1987 | Jones et al. | 364/464.02 |
| 4,787,045 | 11/1988 | Storace et al. | 364/464.02 |
| 4,807,139 | 2/1989 | Liechti | 364/464.02 |
| 4,811,234 | 3/1989 | Storace | 364/464.02 |
| 4,849,884 | 7/1989 | Axelrod et al. | 364/464.02 X |
| 4,864,506 | 9/1989 | Storace | 364/464.02 |
| 4,949,272 | 8/1990 | Vanourek et al. | 364/464.02 |
| 5,077,792 | 12/1991 | Herring | 380/24 |

FOREIGN PATENT DOCUMENTS

| | | |
|---|---|---|
| 2080203 | 2/1982 | United Kingdom . |
| 2188876 | 10/1987 | United Kingdom . |

*Primary Examiner*—Edward R. Cosimano

*Attorney, Agent, or Firm*—Brumbaugh, Graves, Donohue & Raymond

[57] ABSTRACT

A system for remotely resetting a postage meter, by adding a variable amount of postage, includes a computerized central facility or "host", in telephone communication with the meter, which host verifies the meter's identity and ascertains the availability of funds, then sends to the meter an authorizing, unique, one-time-only combination, independent of the value of postage requested, and having a predetermined relation to a unique, one-time-only combination that the meter has generated and retained. The meter then compares the combination that it has generated with the combination received from the host. If the relationship is correct, for example, if the combination is the same, the meter introduces the additional postage requested.

53 Claims, 8 Drawing Sheets

REMOTE RESETTING POSTAGE METER

BACKGROUND OF THE INVENTION

This invention relates to remote telephone resetting of postage meters, remote resetting postage meter systems, and methods for remotely resetting postage meters, and more particularly to meters, systems and methods in which a central or host installation receives requests for resetting a user's meter and verifies the user's identity, and the amount available on deposit before securely authorizing the resetting of the user's meter by the requested amount.

Telephone postage meter resetting is known in the art. Techniques are known for enabling a postage meter user to have his or her meter reset with additional postage by telephone, avoiding the need to carry the meter to a postal authority for authorized resetting. In telephone postage resetting, the user calls the central installation. That installation debits the user's account and supplies the user with a combination that enables the user to introduce into the meter the correct amount of additional available postage.

In the prior art, attention has been given to routines for assuring that the caller is an authorized user before releasing the next of a predetermined number of combinations to the caller. A voice answerback unit has been suggested as the means of informing the caller to enable him or her to enter the combination learned by telephone. The meter could then be reset with a fixed additional increment of postage. Proposals have also been made for the use of a code-bearing means such as a card or a check that is read by a postage meter to enable the introduction of additional postage. Another security-related concern was that the amount of postage being introduced should be only that amount authorized at the central facility. For this purpose certain prior art taught that the combination communicated to the user from the central facility should be dependent upon the amount of postage requested so that a disparity in the authorized resetting amount and the requested amount would result in a disparity, or other incorrect relationship, in the combinations compared at the meter to enable resetting.

Verification that the amount of postage being added to the meter was that amount the user had requested of the central facility has been made at the postage meter rather than at the central facility. This was done by the meter's comparison of the combination that it had internally generated with the combination that the central facility had generated and sent to the site of the meter.

The need for the user to intervene between the meter and the central facility, to receive information from a voice answerback unit and to enter that information to the meter, e.g. by a keypad, introduces the likelihood of user error, requiring a new introduction of the information to the meter or a whole new resetting routine. It is also wasteful of the user's time to have the user stay on the telephone line until the information has been sent by the central facility, and then to touch into the keypad the requisite information.

SUMMARY OF THE INVENTION

In accordance with this invention, a system for remotely resetting a postage meter, by adding a variable amount of postage, includes a computerized central facility or "host", in telephone communication with the meter, which host verifies the meter's identity and ascertains the availability of funds, then sends to the meter an authorizing, unique, one-time-only combination, independent of the value of postage requested, and having a predetermined relation to a unique, one-time-only combination that the meter has generated and retained. The meter compares the combination that it has generated with the combination received from the host. If the relationship is correct, for example, if the combination is the same, the meter introduces the additional postage requested. The terms "unique" and "one-time-only" as used here mean as to the particular transaction. That is, the combination generated by the meter and that generated by the host can be identical, and in a preferred embodiment are identical, but these continue to be unique, one-time-only combinations as that term is understood in the art.

The combinations that permit resetting the meter are generated by software functions, called here "authentication functions", which are program routines in the meter and the host that develop the unique combinations from inputs. In the preferred embodiment, inputs to a combination-producing authentication function include a number representative of the identity of the meter and at least one random number. Both the meter and host generate their combinations before they learn the value of the postage being requested. A random number that was generated by the meter during the last resetting and then stored is a preferred input to the authentication function. In the case of the meter, the combination is generated and stored for later comparison in the course of that resetting. In the case of the host, the combination is generated and stored until the host has learned the value of the amount of postage requested, that the funds are available, and that the meter identification is valid. Thereafter, the host retrieves the combination from storage and sends it to the meter.

Unlike past systems that verify the requested amount at the meter, verification of meter identity and the amount being requested occurs by the meter sending to the host the value of the amount of postage desired along with a code that it has generated, based, at least in part, on the amount of postage desired. Using the requested amount, the host generates a code and compares it with the meter-generated code. Successful comparison, which is typically equality of the received and generated codes, indicates that the meter has been correctly identified, and that the value being requested at the meter is that which has been expressed to the host. The codes generated by the meter and the host are generated by value-confirmation authentication functions that are also program routines contained by both the meter and the host. The value of postage desired is one input to each of the value-confirmation authentication functions. Preferably, another input to the value-confirmation authentication functions is, again, a random number developed by the meter.

In the preferred embodiments of the invention, the compared combinations and the compared codes are successfully compared when they are identical, but of course, depending on how the combinations or codes are generated, a successful comparison might be some other relationship, as for example, a predetermined difference between the two numbers or some chosen ratio of one of the numbers to the other. The authentication functions used to generate the combinations and codes can be a mathematical relationship whose outputs vary unpredictably from one set of inputs to the next. That is to say, the authentication functions should be functions that cannot be ascertained by watching the outputs over a period of time with known inputs. Functions of the desired type are known, and the precise function used does not form a part of this invention.

In addition to the security provided by the above-mentioned generated combination and code numbers that are necessary for resetting, communications between the meter and the host can be encrypted. The host s first response to the meter is the communication of a random number to the meter. Using this random number the host and the meter each independently generate a particular encryption mask, which is then used at various points during the remainder of the meter-host exchange.

The communications protocol between the host and the meter, as described in part above, can be used with either an electronic meter or a mechanical meter to enable resetting automatically from a remote authorizing location or host. Consistent with the use of the term in the art, the expression "electronic meter" used here means a meter that has electronic accounting provisions, in particular an electronic descending register containing the amount of postage remaining to be printed. A mechanical meter is one whose accounting provisions, particularly the descending register, are mechanical, with, typically, mechanical register numerals readable through a window in the meter case.

In the practice of this invention with a mechanical meter, a control sum confirmation value, i.e. a total of the ascending and descending registers as previously read by the user from mechanical register numerals, and not the individual register contents, is retained in electronic memory at the meter and communicated to the host for the purpose of assuring that the meter's registers, which are mechanical, have not been tampered with. A suitably programmed microprocessor sends the code to the host via modem and instructs stepper motors to reset the meter's descending register when it has successfully compared the unique one time only combinations.

BRIEF DESCRIPTION OF THE DRAWINGS

The above and further features and advantages of the invention will be better understood with respect to the following detailed description of a preferred embodiment, taken in combination with the several figures of the associated drawings, in which.

DETAILED DESCRIPTION OF THE PREFERRED EMBODIMENT

Turning now to the drawings in detail, it will be seen from the several figures that there are illustrated (1) a system comprised of a plurality of remotely resettable postage meters and a central, host computer installation, (2) a remotely resettable mechanical meter suitable for use as the meters of the system, and (3) the method of secure resetting of a meter, including flow charts and diagrams representing the program routines and operations of the meters and host computer installation that form the remote resetting system.

The System

Figure 1:
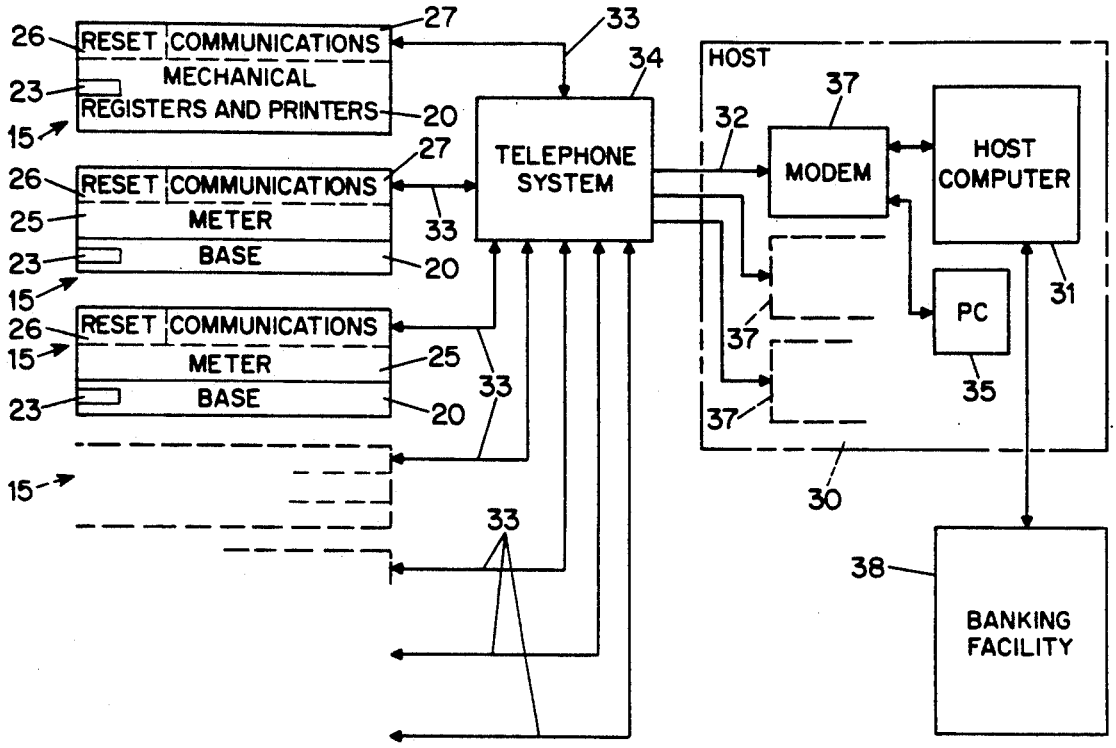
FIG. 1 is a block diagram of a system for remote resetting of postage meters and shows a central, host facility and telephone communication with a series of individual postage meters at user sites.

FIG. 1 illustrates generally the remote postage meter resetting system. Each of a series of postage meter installations 15 has a mechanical meter portion 20 that contains the conventional postage printer and mechanical ascending and descending registers. The mechanical meter portion 20 is associated with a resetting device 26 and a communications unit 27. Conventionally, the mechanical meter portion 20 may be of the kind that prints postage of a desired amount on an envelope introduced into a slot 23.

Figure 2:
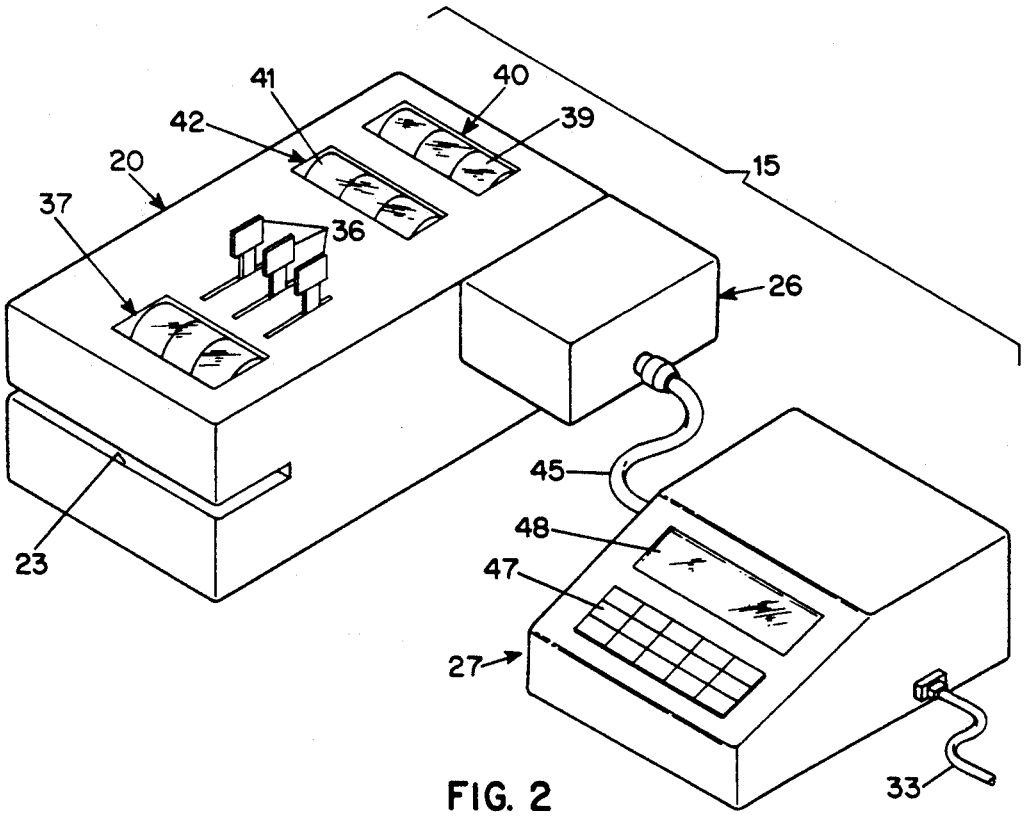
FIG. 2 is a diagrammatic perspective view of a mechanical postage meter that can serve as one of the postage meters of FIG. 1.
Figure 3:
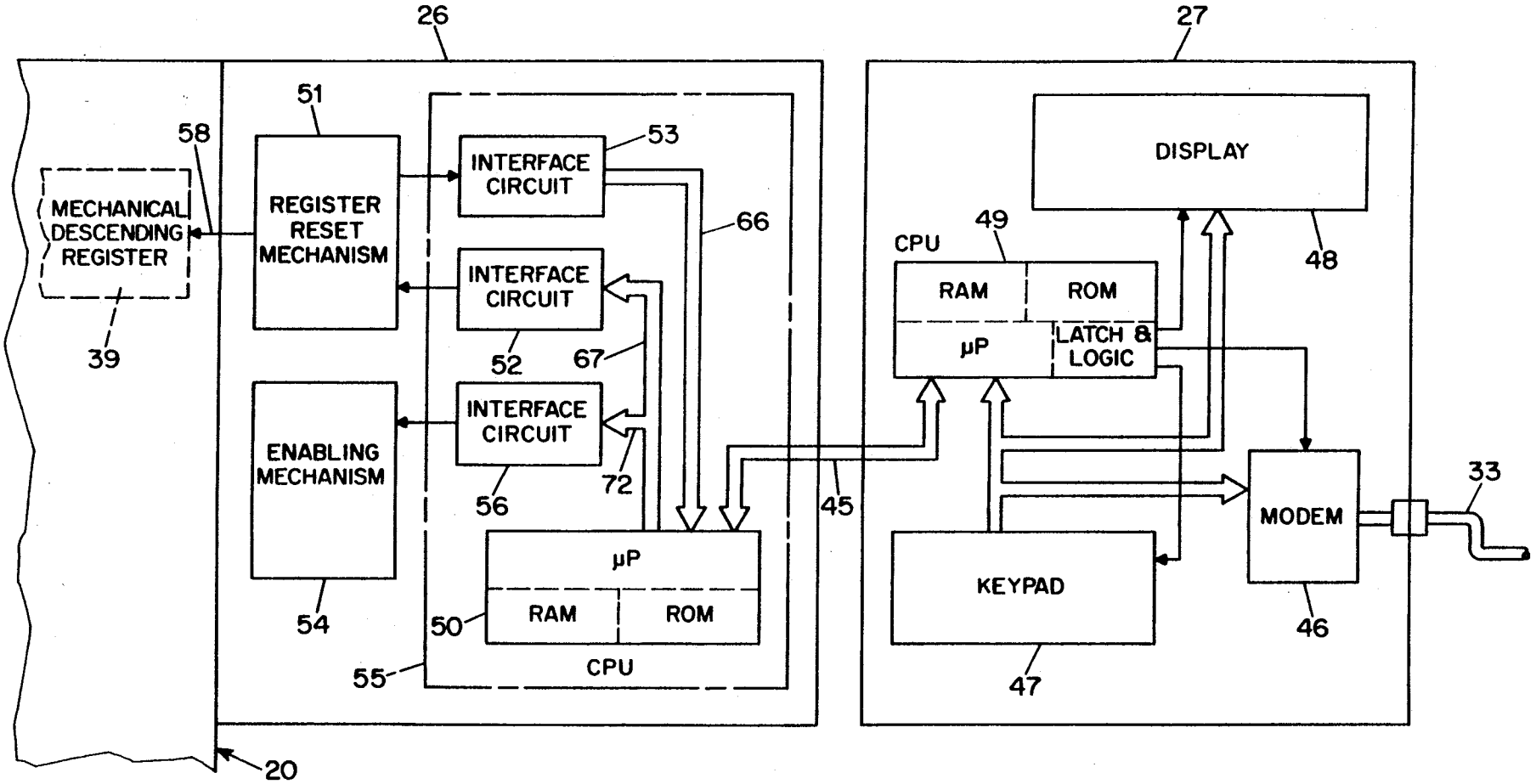
FIG. 3 is a diagrammatic illustration in block diagram form of the major electronic and electromechanical components of the remote meter resetting provisions of the postage meter of FIG. 2.
Figure 4A:
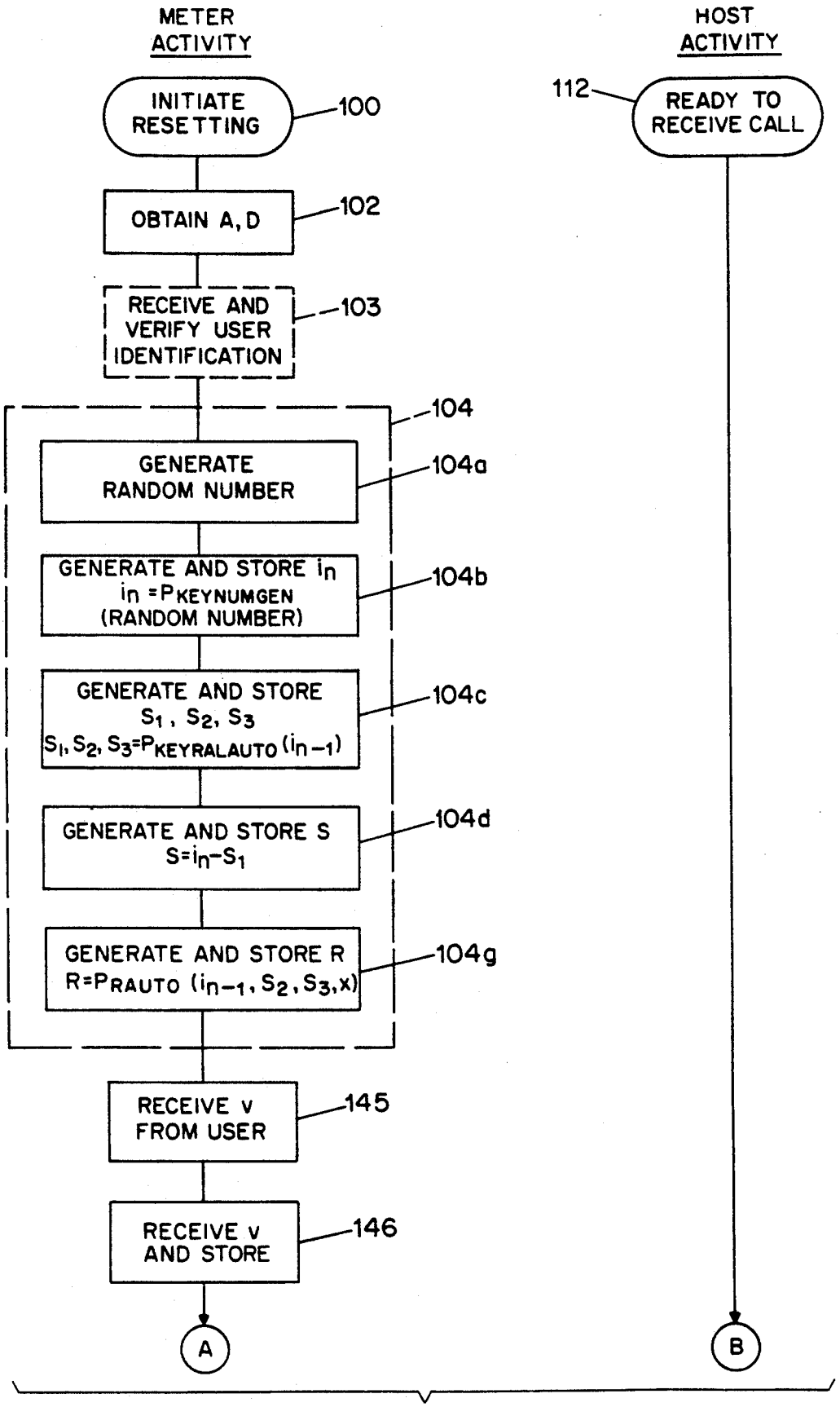
FIGS. 4*a*, 4*b*, 4*c*, and 4*d* and 4*e* together form a diagrammatic illustration in the form of parallel flow charts, illustrating the communications protocol and the operations of a central, host facility and a meter, like the host and meters of FIG. 1, during remote resetting.
Figure 4B:
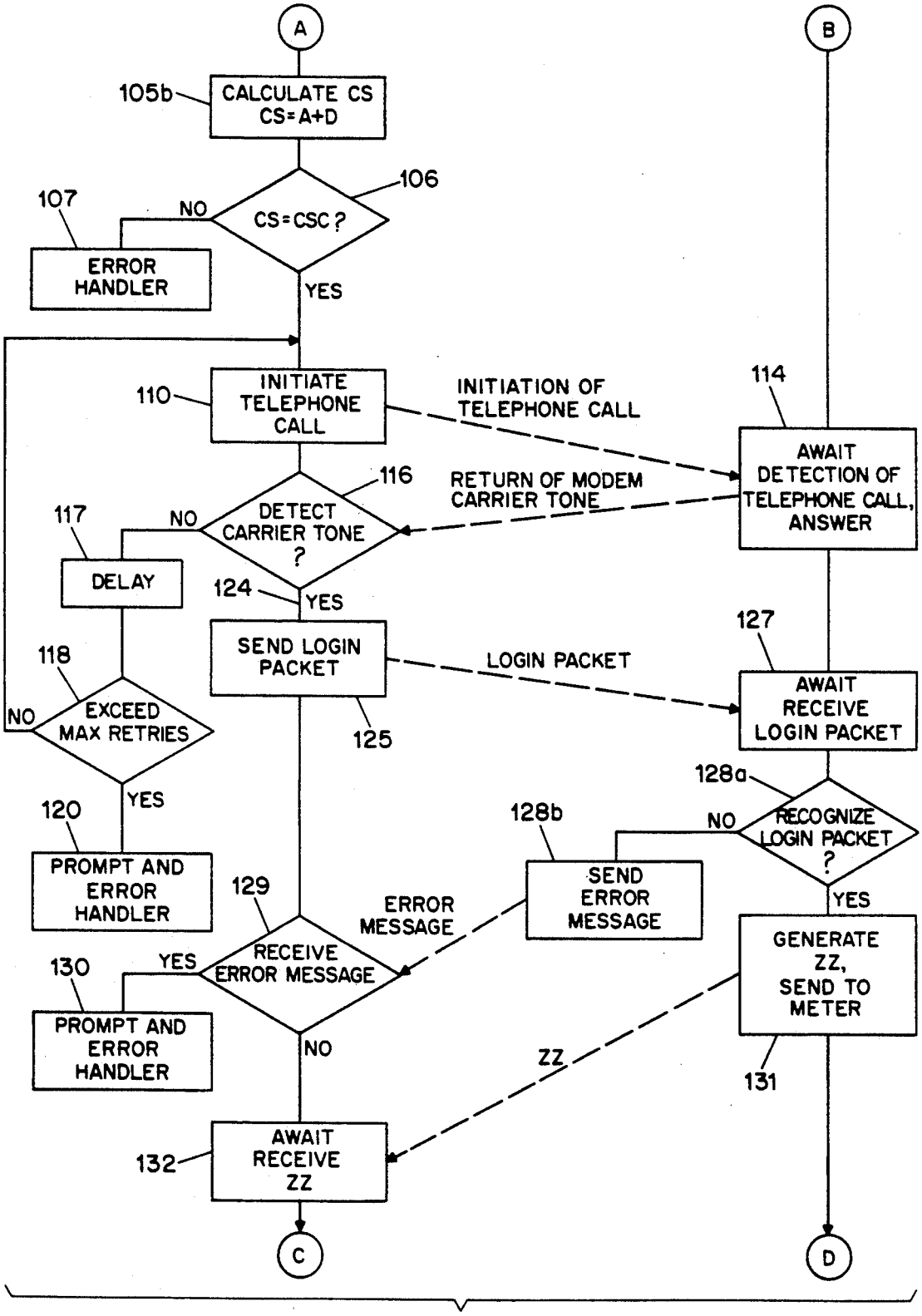
Figure 4C:
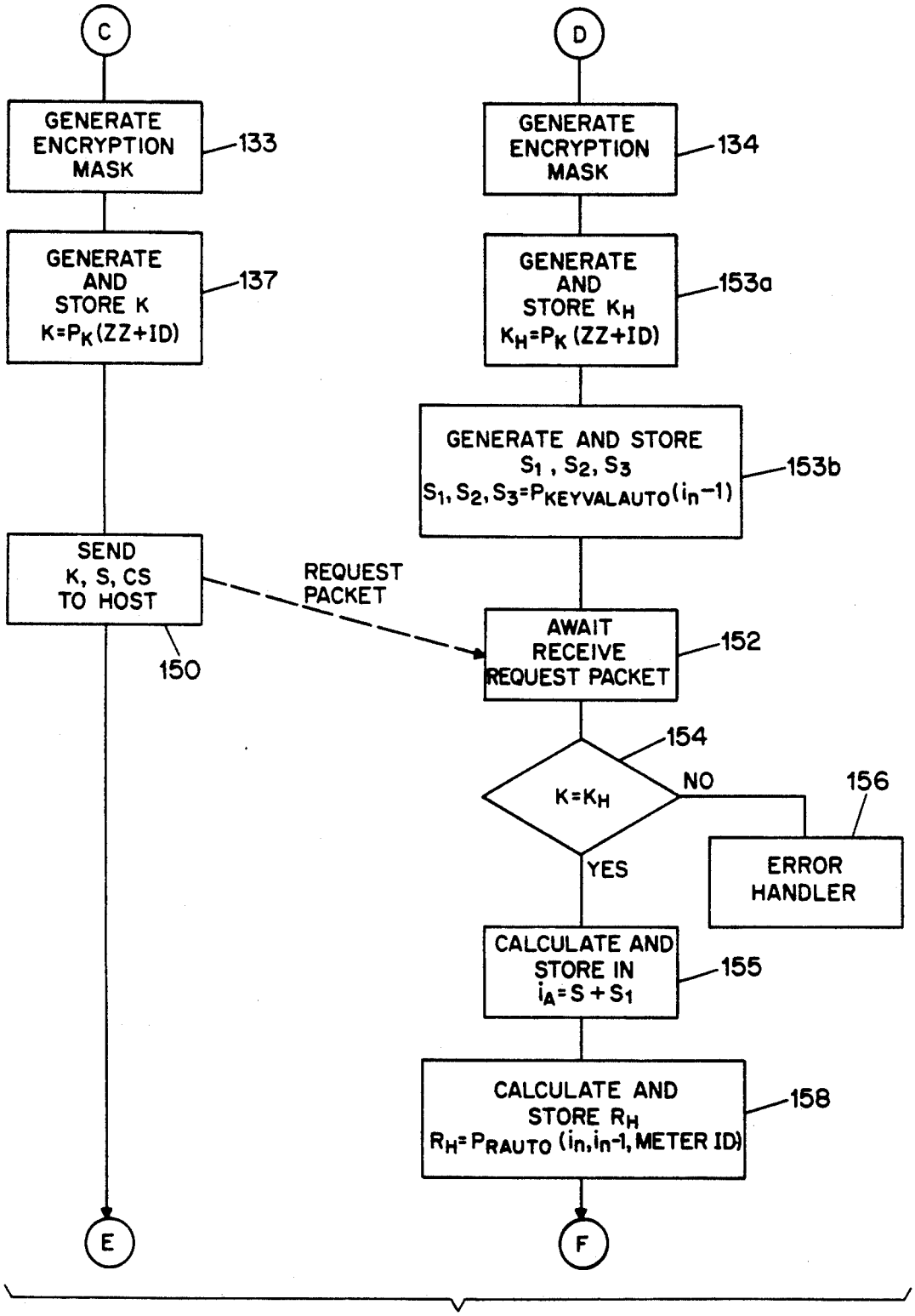
Figure 4D:
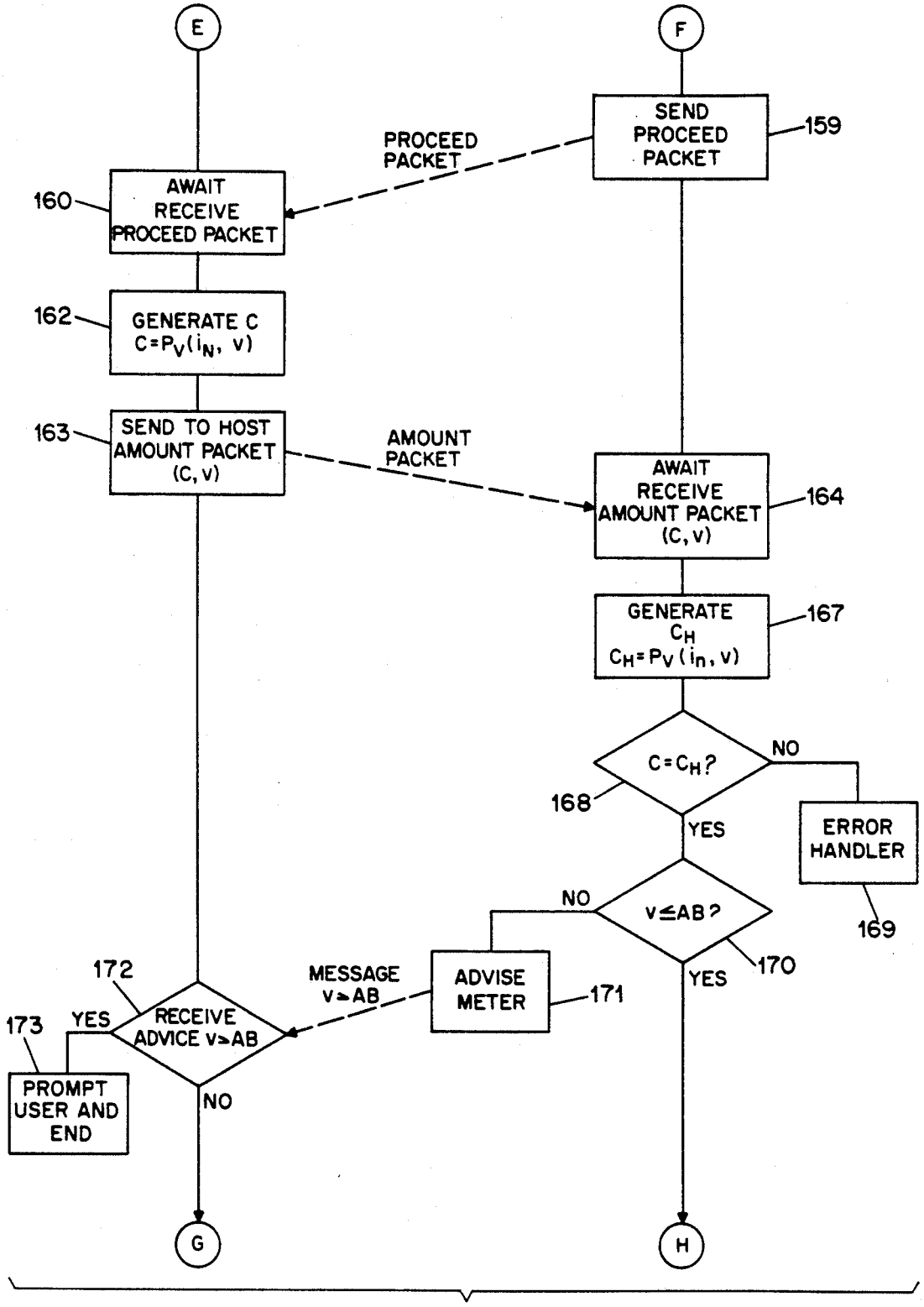
Figure 4E:
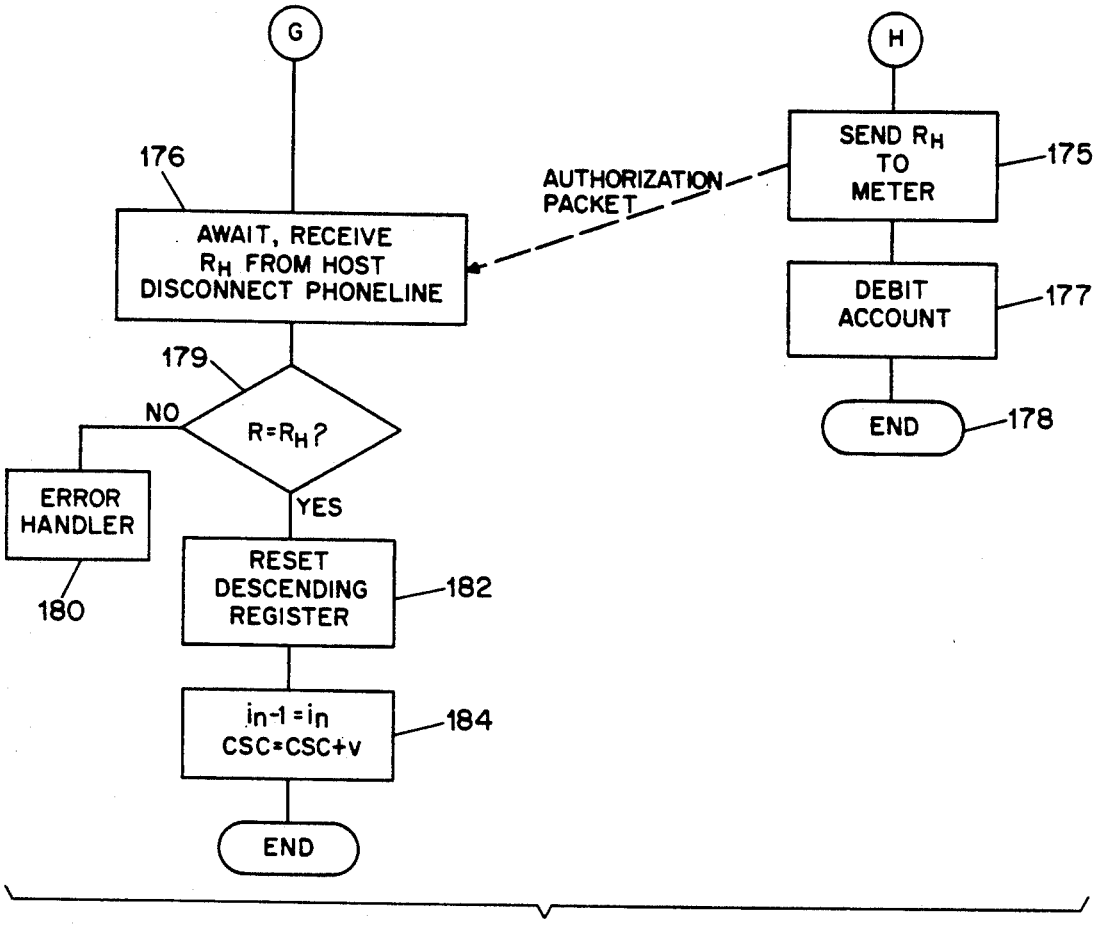
Figure 4F:
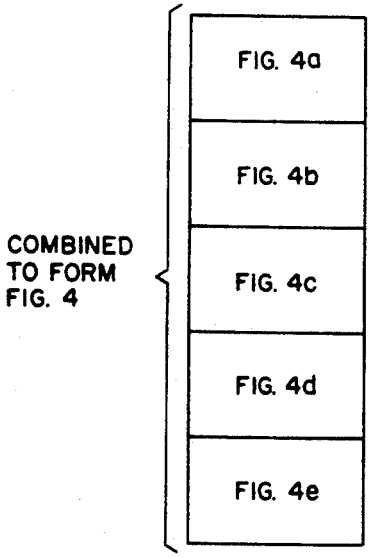
FIG. 4*f* is a diagram illustrating how the flow chart portions of FIGS. 4*a*, 4*b*, 4*c*, 4*d* and 4*e* are to be combined to form the entirety of the flow chart, referred to collectively below as FIG. 4.

As is typical of current postage meters, each meter portion 20 of each installation 15 enables the user to determine the amount of postage to be printed, keeps a record of the amount of postage available in a descending register 39, seen in FIGS. 2 and 3, and adds the amount that has been printed to an ascending register 41, seen in FIG. 2. The resetting device 26, when activated, increases the amount of postage available to be printed by the machine by increasing the total in the descending register 39. The resetting device 26 and its relationship to the mechanical descending register are described in detail in the copending application Ser. No. 333,993, filed Apr. 5, 1989 for "Mechanical Postage Meter Resetting Device and Method," of Horbal and Emmett, now abandoned, continued as application Ser. No. 07/841,893, and commonly assigned, the contents of which are incorporated herein by reference. The communications unit 27 enables the meter to communicate with a remote installation 30, in FIG. 1, called the host. Communications between the host 30 and the communications devices 27 of the installation 15 are by telephone lines 32 and 33 of a telephone system 34, typically the well-known public switched telephone network. A request for additional postage relating to a particular one of installations 15 is conveyed by the telephone connection to the host, and authorization of an increased amount of available postage is conveyed from the host to the particular meter installation 15 by the telephone connection.

The host 30 includes a computer installation 31, a backup personal computer or PC 35, and one or more modems 37 for communicating with the meters 20 via the telephone system 34. As shown, the host computer 31 is also in communication with a banking facility 38.

Each subscribing user of one or more meter installations 15 makes deposits in the banking facility 38, which can be a commercial banking institution. The banking facility 38 maintains individual accounts of the sums thus deposited and available for the user's postage needs. When the host computer 31 receives telephone requests for additional postage from one of the various meter installations 15, it ascertains that sufficient postage is available in the user's account, and the host 30 then authorizes resetting of the pertinent meter, again via the telephone system 34 and as a part of the same telephone call from the installation 15 that requested the additional postage. The host computer 31 includes data storage where the amount of funds available for resetting can be regularly reviewed and revised when additional postage has been credited to a meter. The banking facility 38 is regularly advised of activities and its records are periodically brought up to date. The backup PC 35 enables an operator at the host facility 30 to authorize resetting of a meter if the host computer 31 does not function.

The Postage Machine

Shown in FIG. 2 is the meter installation meter portion 20 is a conventional mechanical meter in this embodiment of the invention. Its mechanical descending register 39 can be viewed through a window 40 and its mechanical ascending register 41 can be viewed through a window 42. Levers 36 permit manual setting of the amount of postage to be printed. The amount of postage set to be printed is visible through a window 37. Introduction of an envelope through the slot 23 activates a conventional printer internal to the meter portion 20, said printer not shown in FIG. 2, to apply the set amount of postage to the envelope. This increments the ascending register 41, adding to it the amount of postage printed, and decrements the descending register 39, subtracting from it that amount. Other mechanical meters have key pads and electronics for setting the amount of postage to be printed, but retain the mechanical accounting features that are the ascending and descending registers. The principles of the invention described here can be practiced with these meters, and they can also be practiced with electronic meters, which is to say meters in which the mechanical ascending and descending registers have been replaced with electronic registers serving the same purpose.

In the installation 15 of FIG. 2, the resetting device 26, or "meter unit" as it called herein, attaches to the exterior of the meter 20, where it cooperates with the conventional resetting provisions by which the mechanical meter 20 would ordinarily be hand-reset at the postal authority. The communications unit 27 is separate from the meter portion 20 and the resetting device 26. It communicates by a cord 45 to resetting device 26, and it connects the telephone line 33. The communications unit has a keypad 47 that enables the user to introduce information for use by the installation 15 or for communication by telephone line 33 to the host 30 of FIG. 1. A display 48 enables information, such as menu selections or instructions, to be communicated to the user from the installation 15 or from the host 30.

Turning now to FIG. 3, the communications unit 27 has a modem 46, seen in FIG. 3, that communicates with the host 30 (not shown in FIG. 3) via the telephone line 33. A CPU 49 has a microprocessor, random access memory RAM), read only memory (ROM), and necessary latches and logic for control of the modem 46, the keyboard 47, and the display 48 by the microprocessor. The CPU 49 is in two-way communication with the host via the modem 46 and the telephone line 33. The keypad 47, including its typical associated circuitry, is connected as an input to the CPU 49, and the display 48, and its typical associated circuitry, is connected as an output from the CPU 49. Other outputs, such as LED's or audible output devices can also be connected as outputs from the CPU 49 or the modem 46 to indicate particular occurrences such as a transaction in progress, an insufficiency of funds in the user's account as determined by the host, an error in information introduced at the keypad 47 by the user, or the "ringing" and then completion of a call to the host. The microprocessor RAM, ROM, modem, keyboard and display are all selected from the variety of known components that are now commercially available.

The meter unit 26 is the resetting device that makes possible resetting of the mechanical meter without carrying the meter to the post office. The meter unit 26 is physically attached to the meter 20 at the location of the entry door where manual resetting is ordinarily accomplished by a postal employee. An interlock, not shown in FIG. 3, incapacitates the meter if the resetting device 26 is removed without authority. Relevant portions of the meter 20 and its resetting device 26 are illustrated in FIG. 3 in block diagram form. This meter resetting device or meter unit 26 has electronics 55 that include a CPU 50. The CPU may include a microprocessor, random access memory, and read only memory all selected from the variety of commercially available components. The meter unit 26 is in communication with the communications unit 27 via the cable 45. A register reset mechanism 51 connects with the CPU 50 of the meter unit 26 via such interface circuits 52 and 53 as required. An enabling mechanism 54 receives instructions from the CPU 50 via such interface circuit 56 as it may require. Enabling mechanism 54 enables the register reset mechanism 51 when appropriate. Output 58 from the register reset mechanism 51 is a mechanical output to increase the available postage in the mechanical descending register 39 of postage meter 20. The exact nature of the mechanical and electromechanical setting provisions including the register reset mechanism 51, the enabling mechanism 54, the circuits 52, 53 and 56, and the mechanical interconnection of the meter unit 26 and the meter 20 are all shown and described in detail in the above-mentioned copending application Ser. No. 333,993, now abandoned, continued as application Ser. No. 07/841,893. Their construction and operation do not form a part of this invention.

The communications unit 27 is responsible for communicating with the remote host computer by its modem 46, receiving information from the user via the keypad 47, providing information to the user via the display 48, and forwarding information to the meter unit 26 via cable 45. The CPU 50 of the meter unit 26 causes the descending register 39 to be reset when it receives an appropriate authorizing input such as a combination that it recognizes as appropriate. During a resetting the CPU 50 develops and stores a combination, then receives the value of the variable amount of postage requested from the communications unit 27, where the user has input this value at the key pad 47. When it has received from the host, via the communications unit 27, an authorization input that it recognizes as valid because it contains the correct combination, the CPU 50 begins the routine that will, first, enable resetting, second, add into the descending register 39 the desired value of additional postage, and third, disable further resetting until such time as resetting is to be reenabled.

Figure 5:
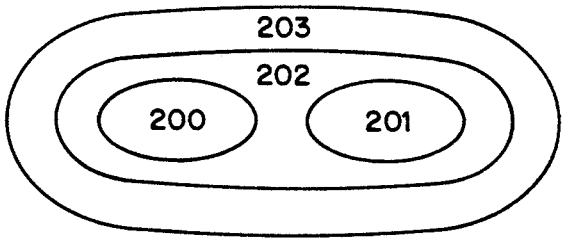
FIG. 5 is a further diagrammatic illustration and shows symbolically the layers of encryption and processing of data packets.

The CPU 50 of the meter unit can include an encryption routine, known to the host 30, capable of encrypting information transmitted to the host 30 on the telephone line 33, via the modem 46, and capable of decrypting information received from the host 30 via that modem. One can use any of several well-known encryption techniques, such as that described below in relation to FIG. 5. All communications between meter and host can be sent under an accepted communications protocol to assure error-free transmissions on the public telephone network. Such a protocol is the Kermit protocol, a known protocol used for this purpose, and which is a development of the Computer Science Department of Columbia University. Such encryption, and error-free transmission protocols do not themselves constitute the invention, but contribute to security and reliability as discussed further below.

The CPU 50 of the meter unit 26 has a value-confirmation authentication function routine to unpredictably generate a code from input numbers for the purpose of verifying at the host the value of the postage that is being requested, as described further below. It also has a combination-producing authentication function routine to unpredictably generate a code or combination from input numbers for the purpose of verifying the host's grant of permission to reset. Such functions, suitable for use in the practice of this invention, are known to those skilled in the art. The selection of the precise function or functions to be used is not a part of this invention. Functions of the kind used are available, for example, from D. E. Knuth, *The Art of Computer Programming*, Vol. 2, Semi-numerical Algorithms, Second printing, November 1971, Addison-Wesley Publishing Co., Reading, Mass., U.S.A. Alternatively, the combinations and codes described below for secure resetting can be generated from tables of random numbers. These can be stored in memory in the meter unit CPU 50, and at the host, the same tables can be stored. A system and method for securely generating combinations in this manner is described in U.S. Pat. No. 4,807,139 dated Feb. 21, 1989, of Hans-Peter Liechti. The routines by which the meter unit CPU 50 and the host computer locate the combination or code from its tables is the "authentication function" when this is the manner of arriving at the appropriate numbers.

In an exemplary embodiment, an authentication function is expressed symbolically as $y=(ax+b) \bmod n$. The input x to the function is multiplied by a, a constant b is added to the product, and the sum is subjected to the mod function, which means that the sum is divided by n and the remainder is kept as the output of the function. Each meter is preprogrammed with constants a, b, and n, and the host is provided with the values a, b, and n for that meter. Security considerations require that the constants a and n be large integers, and n typically be chosen from the set of prime numbers. The particular values a, b, and n are kept secret.

Secure Resetting

In its random access memory, the CPU 50 retains the telephone number of the host. The CPU 50 random access memory contains the control sum confirmation value CSC that is the sum of the ascending and descending meter registers 41 and 39, as of the last resetting. The read only memory of the CPU 50, typically a separate programmable read only memory, contains (1) a login identification number (login ID), (2) a meter identification number (meter ID), (3) a meter serial number, (4) a protocol level identifier, (5) a customer number, and (6) several authentication functions for the generation of code numbers or combinations based on inputs to the authentication functions as discussed in greater detail below, and other permanent information such as a maximum limit on the amount of postage permissibly entered into the descending register during resetting. All of the above are stored in memory inaccessible to the user. The meter serial number appears on the equipment plate of the particular meter, but the login ID and the meter ID are not known to the meter user. The random access memory (RAM) of the meter CPU 50 contains a number called the $S_1$ number that is inaccessible to the user, and is varied with each resetting, but not as a function of the number of resettings.

For each particular meter installation 15, the host computer 31 has in memory (1) the meter serial number, (2) the meter identification number, (3) the login identification number, (4) the customer number and (5) authentication functions identical to those of the meter.

Turning now to FIG. 4, parts a–e, the resetting protocol will be described. As illustrated in the meter and host flow charts of FIG. 4*a*, at resetting time, using the keypad 47, the user initiates resetting, as indicated at 100, for example by inputting to the meter that it is to enter its reset mode. Prompted via the display 48, the user, at 102, enters into the communication unit 27 by its key pad 47, the ascending and descending register values A and D visible through the windows 40 and 42 of the mechanical meter and any identifying data desired. In an electronic meter the ascending and descending register totals can be read electronically by the CPU of the meter without the user's intervention, or the ascending and descending register amounts can be displayed on an appropriate LCD or like display for the user's introduction to the meter CPU via an input such as the keypad. If desired, before proceeding, the meter unit CPU 50 can verify, at 103, the user identification at this point by comparison with a stored identification.

At this time the meter CPU 50 undertakes a number of preparatory procedures or routines 104. The meter CPU first generates a random number, using its own random number generation routine, at 104*a*. Random number generation is known in the art, for example from the time between user key entries. The meter CPU 50 then generates the $i_n$, at 104*b*, using the random number just generated in a function arbitrarily named $p_{keynumgen}$, described below. The number $i_n$ just generated is stored for use in the next resetting. Next, as indicated at 104*c* the meter CPU 50 generates variables S1, S2, S3 using a function arbitrarily named $p_{keywalauto}$ $(i_{n-1})$, where $i_{n-1}$ is the number $i_n$ from the previous resetting. Next, at 104*d* the CPU 50 generates S to be transmitted to the host, where S is equal to $i_n$-S1. The numbers S1, S, S2 and S3 are all stored. Next, at 104*g* the CPU 55 generates the unique one-time-only combination R that will be used to unlock the meter and reset the descending register. The combination R is generated using a function designated $p_{rauto}$, called herein an authentication function, using as input $i_{n-1}$, S2, S3 and an identification number x unique to the meter such as the meter ID. Unlike some prior remote resetting approaches, the combination does not depend on the value of the postage requested (which the meter has not yet learned), nor the number of times that the meter has been reset.

After having generated the unique one-time-only combination R, the last of the preparatory procedures 104, the CPU 50 prompts, at 145, the user, via the communications unit CPU 49 and its display 48, to indicate the amount of postage desired. The meter receives the value v of the postage requested and stores it, at 146. From the ascending and descending register values the meter calculates a control sum CS at 105*b*, FIG. 4*b*, by adding the ascending and descending register values. The meter compares the control sum CS with the control sum confirmation value CSC stored in RAM of the CPU 50, as indicated at the decision block 106. The control sum, which remains the same until a meter is reset, is one indication of the meter not having been tampered with. If, at decision block 106, it is learned that the control sum does not equal the control sum confirmation value in memory, then appropriate action can be taken, at 107, preventing resetting, and, for example, disabling the meter. Preferably, before aborting and/or disabling occurs, the user is given several opportunities to enter the correct register values A and D, to allow for an inadvertent mistake. If the control sum and control confirmation value are equal, the meter continues with the resetting, placing a telephone call to the host at 110.

The host computer 34 waits in a ready condition as indicated at 112 (FIG. 4*a*), and then in response to detection of an incoming call at its modem 37, the host answers the call at 114. At 116, the communications unit CPU 49 learns that the call has been answered due to reception of a carrier tone from the host. In the resettable mechanical meter of FIGS. 1–3 the CPU 50 learns this, like all other communications with the host, via the modem 46 and the communication CPU 49. The host's failure to answer will result in appropriate action by the communication unit CPU 49 at block 116, for example, a slight delay, at 117, and a subsequent call, at 110, or after several more tries determined at 118, a prompt at 120 to try again later and an end to the attempt.

If the communications unit CPU 49 recognizes a successful telephone connection indicated by the yes line 124 from the decision block 116, it then sends to the host at 125 a communication that causes the host to proceed as indicated at 127. This communication, called the login packet, can be used by the host, at 128*a*, to determine that it recognizes the communication protocol, which is to say the format of the communication, before going forward as well as the software version used by the meter. If it does not, at 128*b* it replies to the meter with a message causing the meter, at 129 and 130, to terminate the session advising the user to call the establishment that operates the system if desired. Otherwise the meter awaits a communication from the host at 132. Assuming that the host recognizes the format, it generates a random number zz at 131 using a random number generating function (subroutine) of the host computer 31. The random number zz, thus generated, is sent from the host to the meter, at blocks 131 and 132, and the host 31 and the meter CPU 50 use it to generate identical encryption masks at 133 and 134, FIG. 4*c*. Routines for the generation of encryption masks from seed numbers such as zz are well known in the art. From this point on in the communications between the host and the meter, most messages are encrypted using the mask prior to transmission and are decrypted when received using that mask.

The random number zz is used by the CPU 50 of the meter 20, at 137, to generate and store a further number k using a function $p_k$ with the random number zz and one or more other numbers known to the meter and the host, such as one of the identifying numbers (generally ID) stored in both the meter and the host. The function used to generate k can be any of a number of functions that can be executed by a microcomputer routine to produce an unpredictable number from one or more inputs, and which number varies unpredictably from one input to another. In other words, p, should be such that k cannot be predicted if the inputs zz and the one or more stored numbers are known, and if one were to observe the generation of many k's, knowing the inputs for each generation, one would not be able to perceive the function $p_k$, or to predict the resultant k given another arbitrarily selected input. $P_k$ can be a function like one of those described in Knuth, cited above or it can be a table from which k can be looked up similar to the Liechti patent cited above. At 150 the meter sends to the host k, S, any identifying numbers desired such as the serial number and perhaps a customer number, as well as the ascending and descending register values or values derived therefrom. This packet, called the request packet, is preferably encrypted by the mask discussed above, and the encrypted packet is transmitted error-free via a Kermit protocol.

The request packet is received by the host at 152. The host will already have calculated $k_H$ at 153*a* a using the same authentication function $p_k$ as was used by the meter at 137. By comparing k and $k_H$ at 154, the host determines that the meter and host were communicating pursuant to the appropriate communications protocol and software version. Successful comparison also validates the meter based on any meter identifying inputs to the $p_k$ function. The host had already calculated, at 153*b*, the numbers S1, S2 and S3 using the function $p_{keyvalauto}$ with an input of $i_{n-1}$, which is the $i_n$ that it had stored during the last resetting. If the comparison of k and $k_H$ is successful at 154, then at 155 the host calculates the current $i_n$ from the S it has received plus the S1 it just calculated. This it stores. The host now calculates and stores at 158 the unique one-time-only combination $R_H$ in a manner functionally equivalent to that used by the meter. The host requests the meter to proceed at 159 and 160, FIG. 4*d*. If, at 154, the host's comparison of k and $k_H$ is unsuccessful, then the host moves to an error handler at 156 which may deal with perceived error as deemed appropriate.

The meter calculates at 162 a code number c using an authentication function $P_v$ with inputs of $i_n$ and the value of postage requested v. Both the code number c and the value of requested postage v are sent from the meter at 163 to the host at 164. The host at 167 calculates the code number $c_H$ using the same function $P_v$ and the same inputs $i_n$ and v (which it now knows by virtue of the amount packet). The host then compares the two at 168 to determine that the value v sent is actually the value being requested at the meter. If the host determines that c received is not the same as the $C_H$ it has just calculated, then at 169 it ends the session or takes appropriate other action such as signalling the meter that it should be disabled, for example. If the host determines that the code received is equal to the code just calculated, it then proceeds to retrieve the account balance AB at 170, for example from customer account files in memory, and then determines that sufficient funds to cover the amount of requested postage v resides in the customer's account. If it is determined that the requested amount exceeds the balance, then the user is so advised via the telephone link and the communications unit CPU 49 and its display 49 as shown at 171, 172 and 173. The session is then ended. If the balance is sufficient to cover the requested postage, however, the host transmits, at 175, FIG. 4*e*, the unique one-time-only combination $R_H$ to the meter, at 175, 176, and debits the user's account at 177 before ending its routine at 178.

Figure 6:
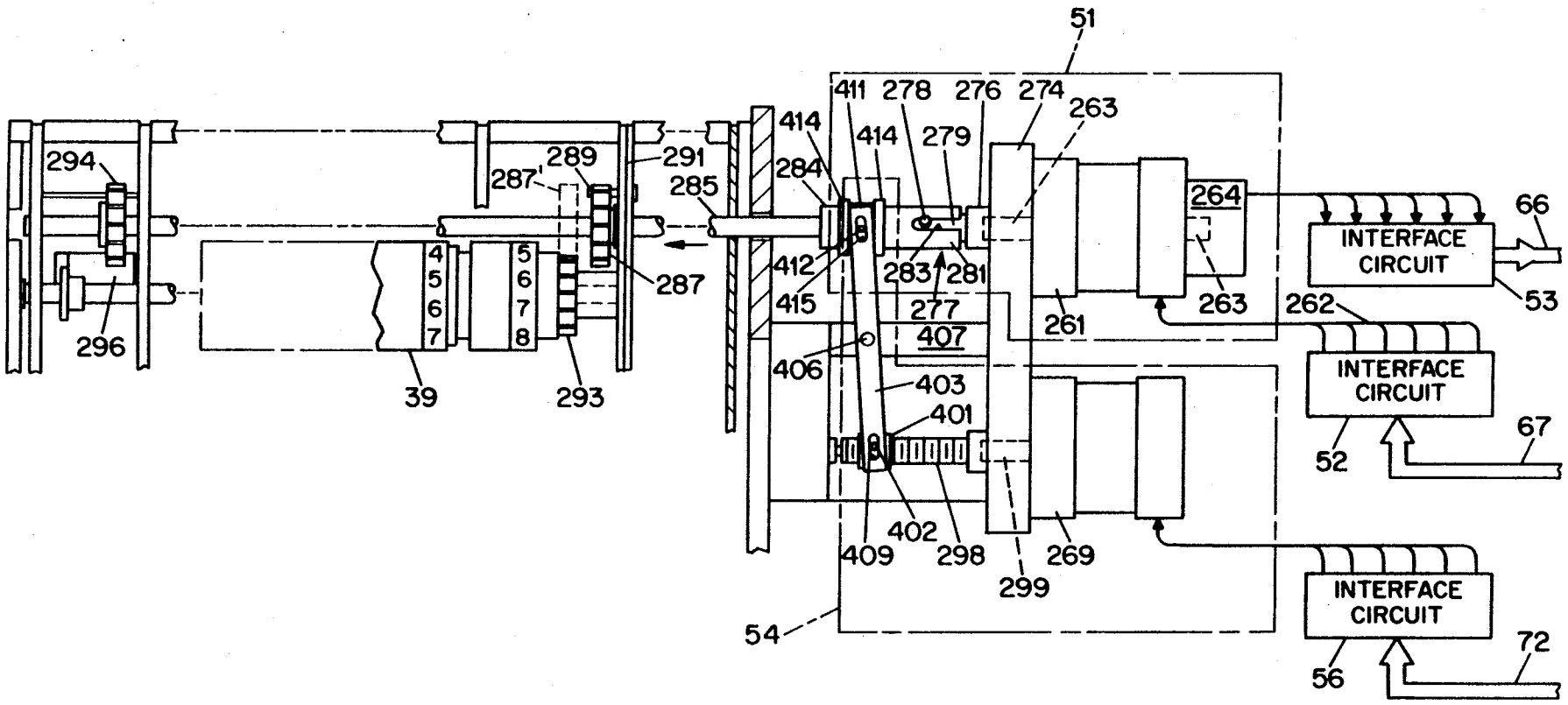
FIG. 6 is a fragmentary plan view, partially in section and partially in block diagram form showing mechanical resetting features of the resettable mechanical meter of FIG. 2.

The meter disconnects from the telephone line at 176 then compares the combination R that it has calculated (the meter-internal combination) and stored with the $R_H$ that it has just received (the meter-external combination) at 179. If they are not the same, the meter ends the session and may take appropriate action such as preventing further transactions using that meter, all at 180, but if the comparison at 179 is successful, the CPU 50 of the meter resetting device proceeds with the resetting routine at 182. The routine for resetting the mechanical meter of the kind shown in FIGS. 2, 3, and 6 is described in the aforementioned commonly assigned patent application of Horbal and Emmett, application Ser. No. 07/333,993, now abandoned, continued as application Ser. No. 07/841,893. In addition the meter rolls over $i_n$ replacing the stored $i_{n-1}$ of the previous resetting with the $i_n$ generated in this resetting, and the meter updates the control sum confirmation value representing the sum of the ascending and descending registers as revised by the addition of v, all as indicated at 184, and the resetting is completed.

Timeouts

It will be appreciated by those skilled in the art that whenever two devices are exchanging information over the telephone lines, provision must be made for the possibility that the connection may be disrupted between steps of the exchange. In the case of the remote resetting protocol shown in FIG. 4 and described above in the detailed discussion of the protocol, there are several points where one of the devices awaits information from the other. For example, at each of blocks 132, 160, and 176 (called "awaiting" blocks) the meter awaits a particular response from the host. The programming of CPU 50 and CPU 49 therefore includes "timeouts", counters that are initialized when an "awaiting" block is entered and that increment with time. If the counter reaches a predetermined value without the expected response from the host, an error handler is invoked.

Likewise, at each of blocks 127, 152, and 164 the host awaits a particular response from the meter. The programming of both the host CPU 31 and the communications unit CPU 49 therefore also include timeouts and associated error handlers. For clarity, neither the timeout variables nor the associated error handlers are shown in FIG. 4.

Levels of encryption

As mentioned above, preferably most or all of the packets sent between the meter and host are encrypted and sent according to an error-free protocol such as the Kermit protocol. The several levels of encryption and protection are collectively portrayed in FIG. 5. For example, when the meter assembles the amount packet, it starts with the requested amount of postage v, shown symbolically as region 200. The meter calculates c by passing v through the function $P_v$, and the number c that results is shown symbolically as region 201. The information of regions 200 and 201 is encrypted using the above-described encryption mask that depends on zz, yielding encrypted information symbolized by region 202. In an exemplary embodiment of the meter of the invention, v is a binary number. C, which is what comes out of $P_v$, when v is given to it, is also a binary number.

The binary number that is region 202 is sent by the meter to the host according to the known Kermit error-free protocol to assure reliable communication. This is not a security feature, as one knowledgeable in Kermit could arrive at the encrypted content 202. In the event of failure, the meter will typically have been programmed so as to resend the packet 203. Error routines are provided in both meter and host to handle this and a variety of exceptional conditions.

The Kermit protocol enables the receiver (which in the example of the amount packet is the host) to determine that it has received a perfect copy of the packet 202 as earlier assembled by the meter. The data packet 202 is decrypted, typically using the same mask as that by which it was encrypted. This yields v and c. The host then passes the value of v through the function $P_v$, to yield a value $c_H$. If $c_H=c$, (or another chosen relationship) then the value has been reliably passed from meter to host.

The Resetting Mechanism

The relationship of the resetting mechanism 51 and the enabling mechanism 54 of FIG. 3 is shown in FIG. 6 in association with the mechanical descending register 39. The resetting mechanism 51 includes a stepper motor 261. The interface circuit 52 is its commercially available control circuit. This circuit converts inputs, on lines 67, from the CPU 50, or an intermediate register, if needed, and converts them to stepping motor inputs to the motor on line 262, to control the amount of rotation of the motor. An encoder 264 is part of the resetting mechanism 51. Its commercially available output circuit is the interface circuit 53 that provides to the CPU 50, or an intermediate register, if needed, an electrical output indication, on lines 66, of the amount of rotation of the shaft 263 of the stepper motor 261. The enabling device 54 includes a stepper motor 269. Its commercially available control circuit is the interface circuit 56. Input data to its commercially available stepper motor control circuit is on lines 72 from the CPU 50 or an intermediate register.

The output shaft 263 of the stepper motor 261 extends through a motor mounting plate 274. Affixed to this end of the shaft 263, a first member 276 of a slidable coupling 277 has a pair of laterally projecting pins 278 (one shown) secured to a reduced diameter portion 279. A second member 281 is slidably mounted on the portion 279, and receives the pins 278 in a pair of axially extending slots 283 (one shown). The second member 281 of the coupling 277 is movable axially while communicating rotary motion from the stepper motor shaft 263.

At its end 284 remote from the motor shaft 263, the second coupling member 281 receives and is affixed to a descending register setting shaft 285. The setting shaft 285 is movable axially from a locked position shown in FIG. 6 to a resetting position. In the locked position of the shaft 285, a descending register resetting gear 287 engages a fixed locking pin 289 secured to a fixed plate 291 in the meter. In this position, the gear 287 and shaft 285 are unable to rotate other than the very slight turning permitted by the clearance between the pin 289 and the gear teeth of the gear 287. In the resetting position of the shaft 285, the gear 287 has moved to the broken line position 287' shown in FIG. 6, where it engages a descending register gear 293. This gear resets the register 39 when turned, increasing the value on the descending register. Registers of the nature of the descending register 39 are known in the art, and indeed previous, manually resettable meters used descending registers of this kind, as well as the axially movable resetting shaft, the locking pin, and the shaft-mounted resetting gear for manual resetting by a postal worker. A descending register detent gear 294 affixed on the setting shaft 285 is engaged by a spring-biased pin 296. The pin 296 is urged radially inward to reside between and in engagement with teeth of the detent gear. The detent pin 296 urges the detent gear 294, the shaft 285 and the resetting gear 287 to a rotational position at which the gear 287 will pass smoothly back into engagement with the pin 289. The detent gear 294 and the detent pin 296 are also conventional in manually resettable postage meters of the kind that are carried to the Post Office to be manually reset by a postal employee.

Automatic resetting of the descending register 39 is begun by the stepper motor 269 moving the setting shaft 285 to the setting position to enable resetting of the register. When instructed by an input to its circuit 56, the motor 269 turns a lead screw 298 secured to an output shaft 299 of the motor. A lead screw nut 401 receives the lead screw 298 in threaded engagement. The nut 401 has secured thereto a pair of laterally extending pins 402 (one shown). A pair of levers 403 (one shown) is pivoted at a fulcrum 406 on a mounting member 407. Slots 409 in the levers 403 receive the pins 402. A bushing 411 on the second member 281 of the coupling 277 has a pair of laterally projecting pins 412, one of which can be seen in FIG. 6. The bushing 411 is captive between shoulders formed by a pair of bosses 414 formed on the axially movable second member 281 of the coupling. One or both shoulders 414 can be a split ring of pliable metal enabling its being spread, placed over the movable coupling member 281, and closed. The second member 281 is rotatable with respect to the bushing. Each lever 403 has a slot 415 receiving one of the pins 412 of the bushing 411. When the CPU 50 receives resetting authorization, an enabling signal is supplied to the stepper motor 269 via its circuitry 56 to drive the lead screw 298. The lead screw nut 401 is retracted towards the stepper motor 269 to pivot the levers 403 and drive the bushing 411, the axially movable member 281 of the coupling 277, and the setting shaft 285 of the meter to the left in FIG. 6. This, then, enables resetting of the descending register 39 by moving the resetting gear 287 into engagement with the descending register gear 293. The gear 287 is now turned an amount determined by an input to the stepper motor 261 via its circuit 52. When the output from the encoder 264, via its circuit 53, and the output line or lines 66, confirm to the CPU 50 that the shaft 263 of the stepper motor 261 has turned an amount corresponding to the amount of postage to be set into the descending register 39, the stepper motor 269 is signaled to rotate the lead screw 298, moving the nut 401 to the left to move the shaft 285 to the right, withdraw the setting gear 287 from the descending register gear 293, and once again lock the setting shaft 285 by engagement of the setting gear 287 with the pin 289. Thus the enabling mechanism 54 that includes the stepper motor 269 disables the resetting mechanism 51 that includes the stepper motor 261. Because the detent pin 296 is located between and in firm engagement with teeth of the detent gear 294, the resetting gear 287 is properly positioned to move onto the pin 289.

The resetting protocol described here is robust. That is, it is secure against any of a variety of intentional or unintentional harms. It will be understood that, while a particular exemplary embodiment has been described, variations and modifications may be effected without departing from the spirit and scope of the present invention as set out in the appended claims.

Those skilled in the art will appreciate that while the above resetting protocol is described in detail with a modem-to-modem data link between meter and host, the method of the invention is applicable to numerous other forms of communication, as several examples will show.

The exchange between meter and host can take place through the mail, with human intervention at both ends of the exchange. While this takes longer to complete than a comparable exchange over the telephone lines, it offers a useful substitute in the event of unavailability of a telephone line or difficulties in interfacing a meter to a private branch exchange.

The exchange between meter and host can take place by means of a vocal exchange, either in person or over telephone lines. This could provide backup capability in the event of modem or other failure at the host, for example.

Finally, the activity at the host during a resetting operation may involve human mediation at one or more stages of the exchange. For example, the various authentication values can be calculated manually or with a standalone microcomputer, and provided to the host for further processing and transmission to the meter.

We claim:

1. A remote resetting postage meter system including a plurality of postage meters at subscriber sites, a central computer installation; each postage meter including a means for printing postage, resettable descending register means for retaining the amount of postage available to be printed by the meter, means for resetting the descending register means by increasing, by a desired variable amount, the amount of postage retained by the descending register, means for activating the means for resetting, communications means for introducing information electronically to the meter, computation means including an authentication function program for generating a unique, retained, one-time-only meter-internal combination unrelated to the desired variable amount of postage; the central computer installation comprising memory means for retaining information relating to each of the meters in the system including the amount of postage available for resetting, computation means including an authentication function program for generating a unique, one-time-only meter-external combination based, at least in part, on the information relating to a meter, and unrelated to the desired variable amount of postage wherein the computation means of the central computer generates the meter-external combination prior to receipt by the central computer of information indicative of the desired amount of postage; the computation means of the meter being adapted to compare the meter-internal and the meter-external combination introduced to the meter from the central computer installation, said computation means of the meter being connected to said means for activating the means for resetting to cause resetting of the descending register by the desired variable amount upon a predetermined relationship of the compared meter-external and meter-internal combinations.

2. The remote resetting postage meter according to claim 1 wherein the resettable descending register means is a mechanical register.

3. The remote resetting postage meter system according to claim 1 wherein the computation means of the meter includes a postage value request program routine that includes developing a code number dependent upon the desired variable amount of postage, and transmitting the code number and the value of the desired variable amount of postage to the central computer installation, the central computer installation having a program routine for developing a verifying code number dependent upon the desired variable amount of postage and comparing the meter-generated code number and the central computer installation-generated verifying code numbers to verify the value of the desired variable amount of postage transmitted to the central computer installation by the meter.

4. The remote resetting postage meter system according to claim 3 wherein the computation means of the meter has a program routine for developing a code development input number and the program routine for developing a code number includes a portion thereof applying the code developing input number and the value of desired variable amount of postage as inputs to a function generating the code number.

5. The remote resetting postage meter system according to claim 4, the meter further comprising a random number generating routine, and wherein the program routine for developing a code development input number includes the introduction of the random number as an input to the code development input number routine.

6. The remote resetting postage meter system according to claim 1 wherein the central computer installation has therein a program routine for verifying meter identity from inputs thereto and availability of requested funds, and causing the meter-external combination to be sent to the meter for comparison with the meter-internal combination when identity is verified and funds are available.

7. The remote resetting postage meter system according to claim 6 wherein each meter computation means and the central computer installation have an encryption program routine for encrypting and decrypting communications between a meter and the central computer installation.

8. The remote resetting postage meter system according to claim 7 wherein the routine for encrypting encrypts the meter-external combination before that combination is sent to the meter.

9. The remote resetting postage meter system according to claim 7 wherein the central computer installation has a random number generator routine, the central computer installation being responsive to a communication from a meter to generate a random number by the random number generator and to send the random number to the meter, the meter and central computer installation encryption program routine comprising means for generating an encryption mask based on the random number.

10. The remote resetting postage meter system according to claim 1 wherein the central computer installation and each meter have a modem for communicating between the central computer installation and the meters, the meters having means for the introduction of data by a user, the authentication function program of the computation means of each meter being responsive to initial inputs to the meter computation means to generate the meter-internal combination prior to introduction by the user of data indicating the variable amount of postage desired.

11. The remote resetting postage meter system according to claim 10 wherein the authentication function program of the central computer installation is responsive to initial identifying inputs from the meter via the modem to generate the meter-external combination prior to receipt of an input from the meter indicating the variable amount of postage desired.

12. The remote resetting postage meter system according to claim 11 wherein the computation means of each meter includes storage means, the storage means comprising a location for the storage of the meter-internal combination for subsequent use.

13. The remote resetting postage meter system according to claim 12 wherein the central computer installation includes a storage location for the storage of the meter-external combination for subsequent transmission to a meter in communication therewith via the modems of the central computer installation and the meter.

14. A remote resetting postage meter comprising a register of postage available from the meter, means for introducing a desired variable amount of additional available postage into the register, a central processing unit having an authentication function routine for generating a meter-internal combination that is a number depending upon inputs to the central processing unit authentication function independent of the desired variable amount of additional available postage wherein the authentication function routine of the meter generates the meter-internal combination prior to transmission from the meter of information indicative of the desired amount of postage, means for receiving into the meter a meter-external combination, and means for enabling the introducing of the desired variable amount of additional available postage when the meter-internal and meter-external combinations are in predetermined relation.

15. The remote resetting postage meter according to claim 14 wherein the central processing unit includes a routine for developing an encryption mask from a random number input, for encrypting outputs from the meter, and for decrypting encrypted inputs to the meter.

16. The remote resetting postage meter according to claim 14 wherein the means for receiving into the meter a meter-external combination includes a modem for receiving by telephone communication the meter-external combination.

17. The remote resetting postage meter according to claim 14 comprising means for receiving from a user a request for additional postage, the central processing unit having a routine for generating a code using the requested additional postage as an input, the central processing unit programmed and connected to deliver the code and the requested value of postage to a meter output for use in requesting approval from a central authority.

18. The remote resetting postage meter according to claim 14 wherein the register of postage available is a mechanical descending postage register and the means for introducing comprises motive means for driving the register in a direction of increasing value, the means for enabling comprising means for connecting the motive means to the register in driving relation, and electrical energizing means connected to the means for enabling to activate the coupling means in response to the meter-internal and meter-external combinations being in the predetermined relation.

19. A telephone meter setting device including a modem, a mechanical meter resetting motive means having a variable mechanical output means operative to reset a postage meter with a variable amount of postage, and electrical control means responsive to an authorization received by telephone by the modem for activating the motive means, and further comprising means for transmitting by modem information indicative of the desired amount of postage further comprising means for electronically comparing a remotely generated combination introduced as at least part of the authorizing input, and an internally generated combination to activate the means for enabling upon determination by the means for electrically comparing of a predetermined relationship between the remotely and internally generated combinations wherein the internally generated combination is generated prior to transmission from the meter of the information indicative of the desired amount of postage.

20. The meter setting device according to claim 19 wherein the motive means for resetting the descending register comprises a resetting motor, the meter further comprising means for introducing electronically a request for a variable amount of postage desired to be added to the descending register during resetting, and electronic motor control means for causing rotation of the resetting motor an amount representative of the electronically introduced request for a variable amount of postage upon enablement of the means for resetting by the means for enabling.

21. The meter setting device of claim 20 wherein the means for electrically comparing includes computation means, the computation means having a routine for developing an encryption mask from a random number input, for encrypting outputs from the meter setting device, and for decrypting encrypted inputs to the meter setting device.

22. The meter setting device according to claim 21, the computation means, further including a program routine for recognizing a unique combination and enabling resetting of the meter only upon recognition of the unique combination.

23. A central postage authorizing facility for use in a remote resetting postage meter system of the kind that includes a plurality of remote postage meters resettable with a requested variable amount of additional postage when authorized by an appropriate combination received from the central facility; the facility including computation means including an authentication function program for generating a unique, one-time-only meter-external combination for use by one of the postage meters for which variable postage is requested to enable the resetting of that postage meter and unrelated to the desired variable amount of postage wherein the computation means is the facility generates the meter-external combination prior to reception from the meter of information indicative of the desired amount of postage, and means for communicating the combination to the location of the remote postage-requesting meter to enable resetting.

24. The central postage authorizing facility according to claim 23 wherein the computation means includes a random number generating means, means to communicate the random number to a postage-requesting meter and a routine for generating an encryption mask from a random number generated by the random number generator.

25. The central postage authorizing facility according to claim 23 wherein the authentication function program includes meter identification data as at least one input.

26. The central postage authorizing facility according to claim 25 including storage means, the storage means having at least one location for storing the meter identification data used in generating the combination.

27. The central postage authorizing facility according to claim 23 further including means for communicating with the resettable postage meters, the computation means comprising a routine for prompting a postage meter for the value of the requested variable amount of postage after generating the unique one-time-only meter external combination.

28. The central postage authorizing facility according to claim 27 wherein the means for communicating is a modem adapted to communicate by telephone line to a modem-equipped postage meter.

29. The central postage authorizing facility according to claim 23 including means retaining an account of the postage available for meters served by the facility, the means for communicating being operative to send the combination only after the computation means has determined that sufficient postage is available to credit a requesting meter with the desired variable amount of postage.

30. The central postage authorizing facility according to claim 29 including storage means, said storage means having a location for storing the combination, said computation means generating the combination prior to receiving the value of the desired variable amount of postage and directing the combination to the storage location pending determination that sufficient postage is available, the computation means retrieving the combination from the storage location and sending the combination after said determination.

31. The central postage authorizing facility according to claim 30 wherein the computation means includes a routine for generating a code dependent upon a received variable amount of additional postage being requested, means for comparing the generated code with a received code, and means of directing a received code to the means of comparing, the computation means providing the combination only when the means for comparing determines a predetermined relationship between the generated code and the received code to verify the amount of postage being requested.

32. The central postage authorizing facility according to claim 31 wherein the computation means has a routine for producing a code generating input number, the routine for generating a code dependent upon a received variable amount of postage being requested including a portion thereof applying the code generating input number and the value of desired variable amount of postage as inputs to a function for generating the code number.

33. The central postage authorizing facility according to claim 31 wherein the computation means has a routine for producing a code generating input number, the routine for generating a code dependent on a received variable amount of postage being requested including a portion thereof applying the code generating input number and the value of desired variable amount of postage as inputs to a function for generating the code number.

34. A central postage authorizing facility for use in a remote resetting postage meter system of the kind that includes a plurality of remote postage meters resettable with a requested variable amount of additional postage when authorized by an appropriate combination received from the central facility; the facility including a computation means with data storage, means for generating authorization information, means for providing input data to the computation means, and means for communicating information from the facility including the authorization for the requested variable amount of additional postage, the computation means including a value verification program routine for generating a code number from an input representation of the value of requested additional postage received at the means for providing input data, and for comparing the code number with an externally generated code, received at the means for providing input data, to verify that the representation of the value is the value of the requested additional postage used to generate the externally generated code, and program means for preventing communications of authorization by the means for communicating in the absence of verification that the representation of the value is the value of requested postage, wherein the means for generating authorization information generates the authorization information without ever having received information indicative of the input representation of the value of requested additional postage.

35. The central postage authorizing facility according to claim 34 wherein the computation means comprises a routine for deriving from a received meter communication a code-development input number for use as an input with the value of requested additional postage value verification program routine, the value verification program routine including inputting the code development input number and value of requested additional postage in a function for generating the code number.

36. A method of remotely resetting postage meters including:

(a) locating a plurality of postage meters at subscriber's sites, remote from a central computer installation, (b) retaining in each postage meter in a descending register the amount of postage remaining to be printed, (c) communicating by telephone via a modem in any one of the postage meters a request for a user-selectable variable additional sum of postage to be entered into the descending register of that meter, (d) formulating at the central computer installation, prior to the communication of the request for the user-selectable variable amount of postage, a unique one-time-only combination unrelated to the desired variable amount of postage, (e) automatically communicating to the meter via modem the combination, (f) determining the authenticity of the combination at the meter, and (g) introducing the requested amount of postage into the descending register when the combination is determined to be authentic.

37. The method of remotely resetting according to claim 36 wherein the step of communicating a request for an additional sum of postage includes formulating at the meter a code based upon the value of postage requested and transmitting the value and the code to the central computer installation, and further including the steps at the central computer installation of formulating a verifying code based on the received value of postage requested, and comparing the meter-formulated code and the verifying code to ascertain that the value received by the central installation corresponds to the value requested by the meter.

38. A method of resetting a postage meter with a variable amount of postage upon authorization from a central, remote installation including:

(a) providing in the postage meter a descending register of the amount of postage remaining to be printed, (b) forwarding a request for a chosen variable amount of additional postage to the remote installation, (c) generating a combination at the meter, prior to the forwarding of the request, independent of the value of postage requested, (d) receiving a combination at the meter from the remote installation, (e) comparing the meter-generated and the received combinations, and (f) introducing into the descending register the amount of postage requested when the meter-generated and received combinations are in predetermined relation.

39. A method of authorizing resetting of a remote postage meter with a user-selected value of postage, said resetting requiring an appropriate combination for resetting from a central, remote installation including the steps of:

(a) providing a central computerized postage authorizing facility, (b) formulating a unique one-time-only combination independent of the value of postage requested and capable of enabling the requested meter to be reset with the desired amount of postage, (c) receiving, subsequent to formulating the combination, by telephone from a remote postage meter a request for the user-selected value of additional postage, (d) transmitting by telephone to the requesting meter the combination to enable resetting of that meter, and (e) debiting an account corresponding to the requesting meter in an amount equal to the user-selected value of postage.

40. A method of authorizing the resetting of a postage meter including the steps of:

(a) providing a central computerized postage meter resetting facility remote from a plurality of postage meters, (b) transmitting from a postage meter a request for additional postage in the form of an indication of the value of the postage requested and a code formulated from the value, (c) receiving at the facility from the postage meter the request for additional postage including the indication of the value of the postage requested and the code formulated from the value, (d) formulating a verifying code at the central facility based on the received value of postage requested, (e) comparing at the central facility the received code and the verifying code, and (f) authorizing by telephone the resetting of the requesting meter with the requested amount of postage when the received and verifying codes have a predetermined relation, said authorizing comprising communicating authorizing information, wherein the authorizing information is generated prior to receiving at the facility the indication of the value of the postage requested.

41. A remote resetting postage meter system including a plurality of postage meters at subscriber sites and a central computer installation; each postage meter including a means for printing postage, resettable descending register means for retaining the amount of postage available to be printed by the meter, means for resetting the descending register means by increasing, by a desired variable amount, the amount of postage retained by the descending register, means for activating the means for resetting, communications means for introducing information electronically to the meter, and computation means including a postage value request program routine that includes developing a code number dependent on the desired variable amount of postage, and transmitting the code number and the value of the desired variable amount of postage to the central computer installation, the computation means also including an authentication function program for generating a unique, retained, one-time-only meter-internal combination unrelated to the desired variable amount of postage; the central computer installation comprising memory means for retaining information relating to each of the meters in the system including the amount of postage available for resetting, means for developing a verifying code number dependent on the desired variable amount of postage and comparing the meter-generated code number and the central computer installation-generated verifying code numbers to verify the value of the desired variable amount of postage transmitted to the central computer installation by the meter, and computation means including an authentication function program for generating a unique, one-time-only meter-external combination based, at least in part, on the information relating to a meter, and unrelated to the desired variable amount of postage wherein the computation means of the installation generates the meter-external combination without ever having received information indicative of the desired amount of postage; the computation means of the computer being adapted to compare the meter-internal combination and the meter-external combination introduced to the meter from the central computer installation, said computation means of the meter being connected to said means for activating the means for resetting to cause resetting of the descending register by the desired variable amount upon a predetermined relationship of the compared meter-external and meter-internal combinations.

42. The remote resetting postage meter system according to claim 41 wherein the computation means of the meter has a program routine for developing a code developing input number and the program routine for developing a code number includes a portion thereof applying the code development input number and the value of desired variable amount of postage as inputs to a function generating the code number.

43. The remote resetting postage meter system according to claim 42, the meter further comprising a random number generating routine, and wherein the program routine for developing a code development input number includes the introduction of the random number as an input to the code developing input number routine.

44. A remote resetting postage meter comprising a register of postage available from the meter, means for introducing a desired variable amount of additional available postage into the meter, a central processing unit having an authentication function means for generating a meter-internal combination that is a number depending on inputs to the central processing unit authentication function independent of the desired variable amount of additional available postage, means for receiving from a user a request for additional postage, wherein the authentication function means of the meter generates the meter-internal combination without ever having received information indicative of the desired amount of postage, the central processing unit having a routine for generating a code using the requested additional postage as an input, the central processing unit programmed and connected to deliver the code and the requested value of postage to a meter output for use in requesting approval from a central authority, means for receiving into the meter from the central authority a meter-external combination, and means for enabling the introducing of the desired variable amount of additional available postage when the meter-internal and meter-external combinations are in predetermined relation.

45. A central postage authorizing facility for use in a remote resetting postage meter system of the kind that includes a plurality of remote postage meters resettable with a requested variable amount of additional postage when authorized by an appropriate combination received from the central facility; the facility including means retaining an account of the postage available for meters served by the facility, computation means including an authentication function program for generating a unique, one-time-only meter-external combination for use by one of the postage meters for which variable postage is requested to enable the resetting of that postage meter said combination and unrelated to the desired variable amount of postage, storage means, said storage means having a location for storing the combination, said computation means generating the combination prior to receiving the value of the desired variable amount of postage and directing the combination to the storage location pending determination that sufficient postage is available, the computation means further comprising a routine for generating a code dependent upon a received variable amount of postage being requested, means for comparing the generated code with a received code, and means of directing a received code to the means of comparing, and means for communicating the combination to the location of the remote postage-requesting meter to enable resetting, the means for communicating being operative to retrieve the combination from the storage location and to send the combination only after the computation means has determined that sufficient postage is available to credit a requesting meter with the desired variable amount of postage, and only when the means for comparing determines a predetermined relationship between the generated code and the received code to verify the amount of postage being requested.

46. A method of remotely resetting postage meters including the steps of:

(a) locating a plurality of postage meters at subscriber's sites, remote from a central computer installation, (b) retaining in each postage meter in a descending register the amount of postage remaining to be printed, (c) formulating in any one of the postage meters a code based upon a user-selected variable additional value of postage requested to be entered into the descending register of that meter, (d) communicating by telephone to the central computer installation via a modem in the postage meters a request for the additional sum of postage comprising the value and the code, (e) formulating at the central computer installation, prior to the communication of the request for the additional sum of postage, a unique one-time-only combination unrelated to the desired variable amount of postage, (f) formulating at the central computer a verifying code based on the received value of the postage requested, (g) comparing at the central computer the meter-formulated code and the verifying code to ascertain that the value received by the central installation corresponds to the value requested by the meter, (h) automatically communicating to the meter via modem the combination, (i) determining the authenticity of the combination at the meter, and (j) introducing the requested amount of postage into the descending register when the combination is determined to be authentic.

47. A remote resetting postage meter system including a plurality of postage meters at subscriber sites, a central computer installation; each postage meter including a means for printing postage, resettable descending register means for retaining the amount of postage available to be printed by the meter, means for resetting the descending register means by increasing, by a desired variable amount, the amount of postage retained by the descending register, means for activating the means for resetting, communications means for introducing information electronically to the meter, computation means including an authentication function program for generating a unique, retained, one-time-only meter-internal combination unrelated to the desired variable amount of postage; the central computer installation comprising memory means for retaining information relating to each of the meters in the system including the amount of postage available for resetting, computation means including an authentication function program for generating a unique, one-time-only meter-external combination based, at least in part, on the information relating to a meter, and unrelated to the desired variable amount of postage; the computation means of the meter being adapted to compare the meter-internal and the meter-external combination introduced to the meter from the central computer installation, said computation means of the meter being connected to said means for activating the means for resetting to cause resetting of the descending register by the desired variable amount upon a predetermined relationship of the compared meter-external and meter-internal combinations; wherein the central computer installation and each meter have a modem for communicating between the central computer installation and the meters, the meters having means for the introduction of data by a user, the authentication function program of the computation means of each meter being responsive to initial inputs to the meter computation means to generate the meter-internal combination prior to introduction by the user of data indicating the variable amount of postage desired; and wherein the authentication function program of the central computer installation is responsive to initial identifying inputs from the meter via the modem to generate the meter-external combination prior to receipt of an input from the meter indicating the variable amount of postage desired.

48. The remote resetting postage meter system according to claim 47 wherein the computation means of each meter includes storage means, the storage means comprising a location for the storage of the meter-internal combination for subsequent use.

49. The remote resetting postage meter system according to claim 48 wherein the central computer installation includes a storage location for the storage of the meter-external combination for subsequent transmission to a meter in communication therewith via the modems of the central computer installation and the meter.

50. A central postage authorizing facility for use in a remote resetting postage meter system of the kind that includes a plurality of remote postage meters resettable with a requested variable amount of additional postage when authorized by an appropriate combination received from the central facility; the facility including computation means including an authentication function program for generating a unique, one-time-only meter-external combination for use by one of the postage meters for which variable postage is requested to enable the resetting of that postage meter and unrelated to the desired variable amount of postage, and means for communicating the combination to the location of the remote postage-requesting meter to enable resetting; the facility including means retaining an account of the postage available for meters served by the facility, the means for communicating being operative to send the combination only after the computation means has determined that sufficient postage is available to credit a requesting meter with the desired variable amount of postage; the central postage authorizing facility including storage means, said storage means having a location for storing the combination, said computation means generating the combination prior to receiving the value of the desired variable amount of postage and directing the combination to the storage location pending determination that sufficient postage is available, the computation means retrieving the combination from the storage location and sending the combination after said determination.

51. The central postage authorizing facility according to claim 50 wherein the computation means includes a routine for generating a code dependent upon a received variable amount of additional postage being requested, means for comparing the generated code with a received code, and means of directing a received code to the means of comparing, the computation means providing the combination only when the means for comparing determines a predetermined relationship between the generated code and the received code to verify the amount of postage being requested.

52. The central postage authorizing facility according to claim 51 wherein the computation means has a routine for producing a code generating input number, the routine for generating a code dependent upon a received variable amount of postage being requested including a portion thereof applying the code generating input number and the value of desired variable amount of postage as inputs to a function for generating the code number.

53. The central postage authorizing facility according to claim 51 wherein the computation means has a routine for producing a code generating input number, the routine for generating a code dependent on a received variable amount of postage being requested including a portion thereof applying the code generating input number and the value of desired variable amount of postage as inputs to a function for generating the code number.

* * * * *

UNITED STATES PATENT AND TRADEMARK OFFICE

CERTIFICATE OF CORRECTION

PATENT NO. : 5,237,506

DATED : August 17, 1993

INVENTOR(S) : John J. Horbal et al.

It is certified that error appears in the above-identified patent and that said Letters Patent is hereby corrected as shown below:

Column 3, line 11, "host s" should read --host's--;
Column 3, line 62, "and 4d" should read --4d--;
Column 5, line 24, "installation" should read --installation 15. The--;
Column 10, line 29, "a using" should read --using--;
Column 15, line 26, "developing" should read --development--;

Column 17, line 43, "means, further" should read --means further--;

Column 22, line 37, "and unrelated" should read --being unrelated--.

Signed and Sealed this

Third Day of January, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,237,506

DATED : August 17, 1993

INVENTOR(S) : John J. Horbal et al.

It is certified that error appears in the above-indentified patent and that said Letters Patent is hereby corrected as shown below:

Column 17, line 35, "claim 20" should read --claim 19--;

Signed and Sealed this

Twenty-eight Day of March, 1995

Bruce Lehman

*Attest:*

BRUCE LEHMAN

*Attesting Officer*

*Commissioner of Patents and Trademarks*